United States Patent [19]

Harwood et al.

[11] Patent Number: 4,836,330

[45] Date of Patent: Jun. 6, 1989

[54] PLURAL CHAMBER STAMP FORMED MUFFLER WITH SINGLE INTERMEDIATE TUBE

[75] Inventors: Jon W. Harwood; Mark S. Kimmet, both of Toledo, Ohio

[73] Assignee: AP Industries, Inc., Toledo, Ohio

[21] Appl. No.: 227,759

[22] Filed: Aug. 3, 1988

[51] Int. Cl.[4] ..... F01N 1/02; F01N 7/18

[52] U.S. Cl. ..... 181/282; 181/266; 181/268; 181/272; 181/276

[58] Field of Search ..... 181/228, 239–255, 181/266–269, 272, 276, 282, 273

[56] References Cited

U.S. PATENT DOCUMENTS

| | | | |
|---|---|---|---|
| 705,357 | 7/1902 | Keating . | |
| 1,110,040 | 9/1914 | Chatain . | |
| 2,484,827 | 10/1949 | Harley . | |
| 2,658,580 | 11/1953 | Trembley . | |
| 2,860,722 | 11/1958 | Gertstung . | |
| 2,943,695 | 7/1960 | Jeffords | 181/243 |
| 3,125,182 | 3/1964 | Earley . | |
| 3,140,755 | 7/1964 | Tranel | 181/282 |
| 3,158,222 | 11/1964 | Richmond | 181/273 |
| 3,176,791 | 4/1965 | Betts et al. | 181/260 |
| 3,198,284 | 8/1965 | Powers | 181/266 |
| 3,412,825 | 11/1968 | Hall | 181/282 |
| 3,638,756 | 2/1972 | Thiele | 181/245 |
| 3,650,354 | 3/1972 | Gordon | 181/240 |
| 3,709,320 | 1/1973 | Höllerl et al. | 181/240 |
| 3,827,529 | 8/1974 | Frietzsche et al. | 181/238 |
| 3,852,041 | 12/1974 | Moore et al. | 60/299 X |
| 4,108,274 | 8/1978 | Snyder | 181/229 |
| 4,132,286 | 1/1979 | Hasui et al. | 181/265 |
| 4,396,090 | 8/1983 | Wolfhugel | 181/282 |
| 4,415,059 | 11/1983 | Hayashi | 181/250 |
| 4,422,519 | 12/1983 | Nomura et al. | 181/228 X |
| 4,456,091 | 6/1984 | Blanchot | 181/282 |
| 4,523,660 | 6/1985 | G[illegible]di | 180/228 |
| 4,700,806 | 10/1987 | Harwood | 181/282 |
| 4,759,423 | 7/1988 | Harwood et al. | 181/282 |
| 4,760,894 | 8/1988 | Harwood et al. | 181/282 |
| 4,765,437 | 8/1988 | Harwood et al. | 181/282 |

FOREIGN PATENT DOCUMENTS

| | | |
|---|---|---|
| 59-155528 | 9/1984 | Japan . |
| 59-43456 | 12/1984 | Japan . |
| 61-155625 | 3/1985 | Japan . |
| 60-111011 | 6/1985 | Japan . |
| 61-14565 | 5/1986 | Japan . |
| 61-108821 | 5/1986 | Japan . |
| 632013 | 1/1950 | United Kingdom . |
| 1012463 | 12/1965 | United Kingdom . |
| 2120318 | 11/1983 | United Kingdom . |

*Primary Examiner*—B. R. Fuller

*Attorney, Agent, or Firm*—Anthony J. Casella; Gerald E. Hespos

[57] ABSTRACT

A stamp formed muffler comprising a pair of internal plates and a pair of external shells is provided. The internal plates are stamp formed to define first and second spaced apart arrays of tubes and a single intermediate tube therebetween. Tubes in one array may have perforations or apertures to permit expansion of exhaust gases, while the other array may define at least one tuning tube. The tubes are disposed on the internal plates such that at at least one location thereon a straight line extending entirely across said internal plates will intersect only the one intermediate tube. The external shells are stamp formed to define a plurality of chambers which cooperate with the tubes in the internal plates. The chambers are separated from one another by a crease disposed to align with the intermediate tube. The crease is characterized by a single outwardly convex portion to engage the single bulb. As a result, the crease is not provided with recesses that conceivably could retain corrosive materials.

17 Claims, 2 Drawing Sheets

PLURAL CHAMBER STAMP FORMED MUFFLER WITH SINGLE INTERMEDIATE TUBE

BACKGROUND OF THE INVENTION prior art exhaust muffler has been formed from a plurality of tubes disposed in a generally parallel array and supported by a plurality of transverse baffles. An outer shell defined by a generally tubular sheet of metal is disposed around the array of tubes and generally in contact with the transverse baffles. The outer shell typically has been of constant elliptical or circular cross section along its entire length. An outer wrapper then is disposed about the tubular shell to dampen shell noise. A pair of opposed end caps are secured to the opposed ends of the tubular shell and outer wrapper and are provided with at least one aperture extending therethrough. The spaces within the wrapped outer shell and intermediate adjacent baffles or intermediate a baffle and an adjacent end cap define chambers within the muffler. Nipples extend through the apertures in the end caps to communicate with the tubes and/or chambers within the prior art muffler. Selected tubes are provided with perforations or louvers to permit communication with the chamber through which the tubes pass. These chambers are generally defined as expansion chambers, and permit exhaust gases traveling through the tubes to expand into the chamber. Expansion chambers contribute substantially to the noise attenuation functions of the prior art muffler. Frequently, however, low frequency noises may not be adequately attenuated by the expansion chambers. Thus, the prior art muffler typically has included at least one low frequency resonating chamber into which a tuning tube extends. The volume of the low frequency resonating chamber and the length and cross section of the tuning tube have been selected in accordance with the specific frequency of the low frequency noise to be attenuated.

The above described prior art wrapped outer shell mufflers have performed well. However, these prior art wrapped outer shell mufflers have required a large number of separate components that must be accurately assembled in labor intensive manufacturing processes. Furthermore, the elongated generally cylindrical configurations of these prior art muffler have made it difficult to fit the prior art wrapped outer shell muffler within the limited available space on the vehicle.

The prior art also includes mufflers formed at least in part by stamp formed components. The typical prior art muffler formed entirely form stamp formed components has consisted of a simple array of perforated tubes disposed within an expansion chamber. Although stamp formed mufflers of this simple construction have attenuated some of the noises associated with exhaust gases, they generally have failed to attenuate at least one range of low frequency noises.

Certain prior art mufflers formed at least in part from stamp formed components have attempted to deal with low frequency noise attenuation. In particular, U.S. Pat. No. 3,140,755 which issued to Tranel on July 14, 1964, shows a muffler formed to include a main tube and a plurality of dead end spur tubes intersecting the main tube. The spur tubes are of different lengths with the number and configuration of spur tubes being selected to attenuate specific low frequency noise. The muffler shown in U.S. Pat. No. 3,140,755 does not provide the combination of an expansion chamber and plural low frequency resonating chambers communicating with an array of tubes, and therefore would be of limited effectiveness in attenuating sounds associated with a vehicular engine.

Japanese Patent No. 59-43456 shows a muffler formed at least partly from stamp formed components and including one low frequency resonating chamber and an expansion chamber. However, to achieve the low frequency resonating chamber, the muffler shown in Japanese Pat. No. 59-43456 must include a plurality of separate tubular members to extend through the outer shell of the muffler, pass entirely through the low frequency resonating chamber and be secured to stamp formed components well within the muffler. Thus, the muffler shown in Japanese Patent No. 59-43456 and including a single low frequency resonating chamber is effectively a hybrid muffler comprising both tubular and stamp formed components. The muffler shown in Japanese Patent No. 59-43456 would necessarily be substantially more complex with more tubular components if plural low frequency resonating chambers were provided.

U.S. Pat. No. 4,415,059 which issued to Hayashi on Nov. 15, 1983, shows an elongated stamp formed muffler comprising two generally cylindrical members linked in end-to-end relationship to effectively define a sausage-like structure. The muffler comprises a pair of internal plates which are stamp formed to define a single linear exhaust passage. A pair of external shells are stamp formed to surround the internal plates. The external shells are necked down at a generally central location to surround the stamp formed central linear tube and to thereby form chambers around portions of the tube. The tube passing through one of the chambers is perforated. Thus, the chamber surrounding the perforated portion of the single linear tube is an expansion chamber which attenuates a high frequency noise. The portion of the central tube in the other chamber is punch formed to define a pair of short straight flanged openings which extend perpendicular to the longitudinal axis of the central linear tube. The flanged openings are intended to function as tuning passages which communicate with a low frequency resonating chamber defined by the external shell.

The combination of short punch formed tuning passages and low frequency resonating chambers as shown in U.S. Pat. No. 4,415,059 is necessarily limited both functionally and structurally. In particular, the frequency of the sound to be attenuated by a combined tuning tube and low frequency resonating chamber is inversely proportional to the square root of the length of the tuning tube, inversely proportional to the square root of the volume of the low frequency resonating chamber and directly proportional to the square root of the cross sectional area of the tuning tube. Thus, longer tuning tubes can attenuate lower frequency sounds. Similarly, the larger the volume of the low frequency resonating chamber, the lower the frequency of the sound to be attenuated. Conversely, within certain limits, narrower tuning tubes attenuate a narrower range of low frequency sounds.

The punch formed tuning passage shown in U.S. Pat. No. 4,415,059 positively prevents the provision of long tuning tubes. Short tuning tubes or passages correspond to high frequency sound attenuation. Thus, the muffler shown in U.S. Pat. No. 4,415,059 would have limited effectiveness in attenuating the low frequency sounds for which tuning tubes are primarily intended. Any attempt to lengthen the punch formed passages shown in the muffler of U.S. Pat. No. 4,415,059 by widening the punch formed passages would be self-defeating since the radius squared is in the numerator of the equation which dictates the frequency of the sound to be attenuated. Thus, lengthening the punch formed passages of the muffler shown in U.S. Pat. No. 4,415,059 would in many instances have the effect of increasing the frequency of the sound attenuated. Furthermore, the punch formed construction of the tuning passage shown in U.S. Pat. No. 4,415,059 positively can not be curved. Thus, the length of these straight punch formed tuning passages extending orthogonal to the longitudinal through tube would be limited by the proximity of the outer shells.

Recently, several improvements to stamp formed mufflers have been made. In particular, U.S. Pat. No. 4,700,806 issued to Jon Harwood on Oct. 20, 1987, and U.S. Pat. No. 4,736,817 issued to Jon Harwood on Apr. 12, 1988, and both are assigned to the assignee of the subject invention. U.S. Pat. No. 4,700,806 and U.S. Pat. No. 4,736,817 are directed to extremely efficient, effective and inexpensive mufflers formed from stamp formed components. These mufflers include arrays of stamp formed tubes, which may include tuning tubes, and further comprise a plurality of chambers, which may include expansion chambers and low frequency resonating chambers. The mufflers shown in U.S. Pat. No. 4,700,806 and in U.S. Pat. No. 4,736,817 attenuate noise at least as well as, or better than, the prior art wrapped outer shell mufflers. However, these stamp formed mufflers can be manufactured from many fewer components and in processes that are well suited to automation. Additionally, the stamp formed mufflers are lighter than conventional mufflers.

Additional improvements to stamp formed mufflers have been made even more recently and are described and claimed in co-pending patent applications that are assigned to the assignee of the subject application. For example, U.S. patent application Ser. No. 061,876 is directed to an "EXHAUST MUFFLER WITH ANGULARLY ALIGNED INLETS AND OUTLETS". U.S. patent application Ser. No. 061,913 is directed to the "TUBE AND CHAMBER CONSTRUCTION FOR AN EXHAUST MUFFLER". U.S. patent application Ser. No. 106,244 described an efficient construction for a "STAMP FORMED MUFFLER WITH MULTIPLE LOW FREQUENCY RESONATING CHAMBERS" and enables at least two stamp formed tuning tubes and at least two low frequency resonating chambers to be provided in the muffler with a substantially reduced deformation of the stamp formed outer shell.

U.S. patent application Ser. No. 146,032 is directed to a "STAMP FORMED MUFFLER WITH CONFORMAL OUTER SHELL" to enable the muffler to conform to the limited available space on a vehicle. The disclosures of the above identified patents and applications assigned to AP Industries, Inc. are incorporated herein by reference.

Certain of the stamp formed mufflers described and illustrated in the preceding patents and patent applications assigned to AP Industries, Inc. have included an array of tubes defined by the stamp forming of internal plates and a plurality of chambers defined by the stamp forming of external shells. Certain of these chambers have been separated from one another by a stamp formed crease extending substantially entirely across the muffler. The crease has divided, for example, a low frequency resonating chamber from an expansion chamber of the muffler. Typically, the crease has included a plurality of outwardly convex arcuate portions disposed and dimensioned to engage the stamp formed tubes defined by the internal plates. Thus, these arcuate portions enable the stamp formed tubes to extend between the several chambers of the muffler. Typically, one such arcuate portion would engage a stamp formed tube extending to or from an inlet or outlet of a muffler, while at least one, and generally two, additional arcuate portions would engage tuning tubes of the muffler. Although the mufflers described in the related patents and applications identified above perform extremely well, it has been noted that the plural outwardly convex arcuate portions disposed in the crease between adjacent chambers effectively define depressions or reservoirs therebetween. Depending upon the location and orientation of the muffler on the vehicle and depending upon the environment in which the vehicle is employed, it has been noted that these depressions or reservoirs conceivably could retain liquids on the upper side of the muffler. In some environments, these liquids may contain salts or other potentially caustic chemicals. Although the metallic materials used for the stamp forming can generally resist the corrosive action of any retained liquids or salts, it is considered desirable to minimize any potential risk of premature failure of the muffler. Additionally, an overriding objective of most stamp forming processes is to minimize the amount of metal deformation required.

In view of the above, it is an object of the subject invention to provide a stamp formed muffler that does not include externally disposed reservoirs in which liquids, salts or other corrosive materials could be retained.

It is another object of the subject invention to provide a stamp formed muffler having at least one expansion chamber and a plurality of low frequency resonating chambers, but with only one tubular portion extending therebetween.

A further object of the subject invention is to provide a stamp formed muffler having tubular portions defined by internal plates and chambers defined by external shells and having only one tubular portion extending between adjacent chambers formed in the external shells.

An additional object of the subject invention is to provide a stamp formed muffler employing branch tuning with elongated tuning tubes.

Still a further object of the subject invention is to provide a stamp formed muffler having at least one tuning tube aligned at an acute angle to the inlet tube of the muffler.

SUMMARY OF THE INVENTION

The subject invention is directed to a stamp formed muffler comprising a pair of plates secured in face-to-face relationship. At least one of the plates is formed to define arrays of channels therein, with the channels being disposed to define arrays of formed tubes intermediate the plates. For example, the channels in one plate may be disposed substantially in register with corresponding channels in the opposed plate, such that each formed tube in the arrays is defined by opposed channels. Alternatively, at least portions of selected formed tubes may be defined by a channel in one plate disposed adjacent a planar portion of the opposed plate.

The tubes defined by the channels of the opposed plates comprise at least one inlet to the muffler, at least one outlet from the muffler and arrays of tubes disposed therebetween. More particularly, the plates are formed to define first and second spaced apart arrays and a single intermediate tube extending between and connecting the first and second arrays. For example, the first array may be disposed adjacent one longitudinal end or lateral side of the plates, while the second array may be disposed adjacent the opposed longitudinal end or lateral side. One array may comprise the inlet to the muffler, while the other array may comprise the outlet from the muffler. The spaced apart orientation of the arrays of tubes is such that a plane may be defined orthogonal to the plates and extending entirely thereacross which intersects only the single intermediate tube.

The tubes formed in the first or second array may be provided with perforations, louvers, apertures or the like to permit communication of exhaust gases traveling through the tubes with an expansion chamber formed thereabout, as explained further below.

The tubes in the first or second arrays may alternatively be formed to define at least one tuning tube which intersects at least one other tube in the array. Preferably, a plurality of tuning tubes are formed in either the first or second array to intersect at least one other tube in the array. For example, the tuning tubes may be part of the first array, while the perforated tubes may be part of the second array.

The tuning tubes may be disposed to intersect other tubes in the array at spaced apart locations. The intersection of the tuning tube with another tube in the array may define an acute angle such that the tuning tube is aligned to the downstream portion of the adjacent tube at an angle of less than 90°. This angular alignment of the tuning tube to the intersecting tube in the array may achieve or approach a "driven" tuning which in some instances is more effective in attenuating a particular low frequency range of noise.

The muffler further comprises at least one external shell secured to the formed plates. The shell is formed to define first and second discrete chambers which surround the first and second arrays of tubes defined by the channels formed in the plates. The muffler may comprise a pair of opposed external shells at least one of which is formed to define first and second discrete chambers.

The chambers formed in the external shell may extend away from a peripheral flange which may be generally planar. The chambers may further be defined by a crease extending intermediate the chambers. For example, the crease may extend between and connect spaced apart locations on the peripheral flange. The muffler may define a generally elongated structure, with the crease extending transverse to the direction of elongation. However, many other muffler configurations are possible depending upon the available space on the vehicle, and the direction and orientation of the crease will depend substantially entirely upon the space and noise attenuation requirements of the muffler.

The crease between two chambers formed in the external shell is disposed and aligned to extend across a portion of the internal plates having the single intermediate tube formed therein. Thus, the crease will be defined by only one outwardly convex arcuate portion to engage the one tube connecting the two arrays and passing between the two chambers. Remaining portions of the crease may be generally planar and may lie in the same plane as the peripheral flange. By virtue of this construction, the crease between the external shells does not define depressions or reservoirs that could allow the accumulation of potentially corrosive materials that otherwise conceivably could shorten the life of the muffler. Furthermore, this construction reduces the amount of metal deformation required in the crease intermediate the chambers of the external shell.

DETAILED DESCRIPTION OF THE PREFERRED EMBODIMENTS

Figure 1:
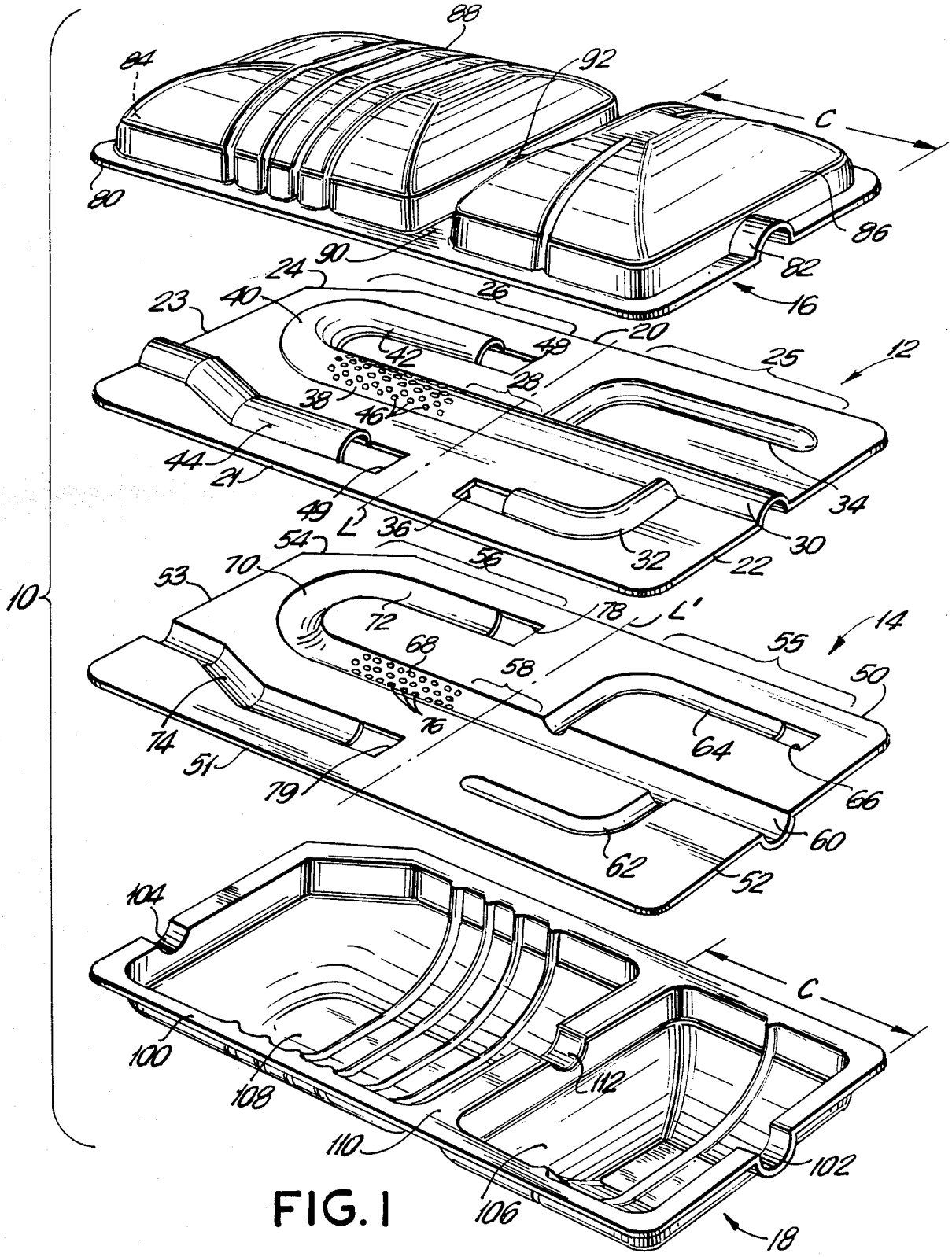
FIG. 1 is an exploded perspective view of a muffler in accordance with the subject invention.
Figure 2:
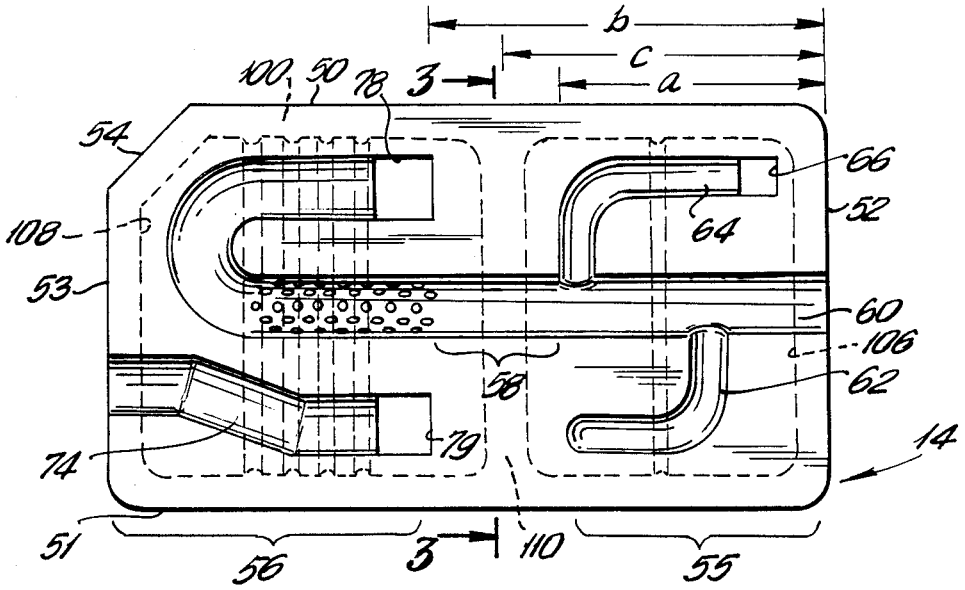
FIG. 2 is a cross-sectional view of the assembled muffler taken along a line intermediate the two internal plates.
Figure 3:
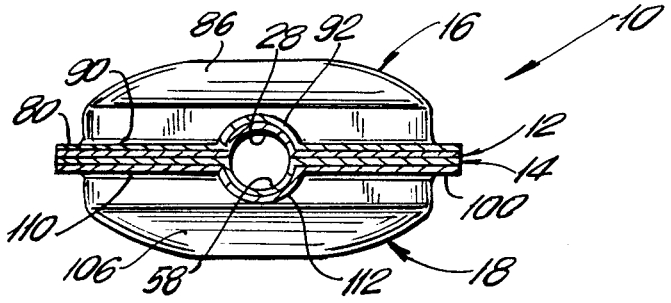
FIG. 3 is a cross-sectional view of the muffler taken along line 3—3 is FIG. 2.

The stamp formed muffler of the subject invention is identified generally by the numeral 10 in FIGS. 1–3. The muffler 10 comprises first and second internal plates 12 and 14 respectively which are secured to one another in generally face-to-face relationship. The muffler 10 further comprises first and second external shells 16 and 18 which are securely mounted to and surround the internal plates 12 and 14. The internal plates 12 and 14 are formed to define arrays of tubes therebetween, as explained in greater detail below. The external shells 16 and 18 are formed to define a plurality of chambers which cooperate with the tubes defined by the internal plates 12 and 14. The formation of the internal plates 12 and 14 and the external shells 16 and 18 may be carried out with available stamp forming equipment employing known manufacturing processes. However, it is envisioned that other metal forming processes may also be employed, such as those utilizing hydraulic forces, magnetic forces or explosive forces to deform the metal.

The internal plates 12 and 14 are deformed to define arrays of channels disposed therein such that the channels define arrays of tubes between the interconnected internal plates 12 and 14. As depicted in FIGS. 1–3, the tubes are defined by generally juxtaposed or registered channels formed in each of the two internal plates 12 and 14. However, as noted above, it is envisioned that selected portions of tubes may be defined by a channel formed in one internal plate and disposed in face-to-face contact with a generally planar portion of the opposed plate.

The first internal plate 12 is depicted as being of generally rectangular configuration with opposed longitudinal sides 20 and 21 and opposed ends 22 and 23. The first internal plate 12 further comprises a truncated corner 24 which is illustrated to generally show that neither the internal plate 12 nor the entire muffler 10 is required to be of rectangular plan view configuration. It is envisioned that many other nonrectangular plan view configurations may be appropriate depending upon the available space on the vehicle.

The first internal plate 12 is stamp formed to include a first array of channels 25, a second array of channels 26 and an intermediate channel 28. The first array of channels 25 comprises an inlet channel 30 and first and second tuning channels 32 and 34. The inlet channel 30 extends generally parallel to the side edges 20 and 21 from the first end 22 of the internal plate 12, and is substantially free of perforations.

The first tuning channel 32 of the first array of channels 25 communicates with the inlet channel 30 at a location thereon in proximity to the first end 22 of the first internal plate 12. The first tuning channel 32 is aligned approximately orthogonal to the inlet channel 30 at their intersection. However, the tuning channel 32 undergoes an approximately right angle bend at locations thereon spaced from the inlet channel 30 such that the end of the first tuning channel 32 is aligned generally parallel to the inlet channel 30. The first tuning channel 32 terminates at a tuning aperture 36 extending entirely through the first internal plate 12. As will be explained further below, the length and cross-sectional dimension of the first tuning channel 32 is selected in accordance with a particular low frequency sound to be attenuated thereby.

The second tuning channel 34 is aligned approximately orthogonal to the inlet channel 30 at their intersection. The second tuning channel 34, however, then undergoes a bend to be directed back toward the first end 22 of the first internal plate 12. The second tuning channel 34 of the first internal plate 12 is continuous along its entire length, and does not terminate at a tuning aperture The intersection of the second tuning channel 34 with the inlet channel 30 is spaced from the first end 22 of the first internal plate 12 by a distance "a" as shown in FIG. 2.

The second array of channels 26 formed in the first internal plate 12 comprises a perforated channel 38, a smoothly curved reversing channel 40, a return channel 42 and an outlet channel 44. The perforated channel 38 is characterized by an array of perforations 46 formed therein beginning at a location spaced a distance "b" from the first end 22 of the first internal plate 12 as shown in FIG. 2. It will be noted that the distance "b" exceeds the distance "a". The curved reversing channel 40 extends continuously between the perforated channel 38 and the return channel 42. The return channel 42 terminates at a cross flow aperture 48. The outlet channel 44 extends from another cross flow aperture 49 to the second end 23 of the first internal plate 12.

The intermediate channel 28 extends between and connects the inlet channel 30 and the perforated channel 38. It will be noted that a line L or plane can be extended entirely across the internal plate 12 between sides 20 and 21 to intersect only the intermediate channel 28.

The second internal plate 14 is substantially a mirror image of the first internal plate 12. However, as noted above, this precise mirror image configuration is not required. The second internal plate 14 defined by opposed longitudinally extending side edges 50 and 51, opposed first and second end edges 52 and 53 and a truncated corner 54 which is depicted generally to show that a rectangular plan view configuration is not required.

The second internal plate 14 is stamp formed to define first and second arrays of channels 55 and 56 and an intermediate channel 58. The first array 55 comprises an inlet channel 60 stamp formed in the second internal plate 14 extending from the first end 52 thereof. The inlet channel 60 is intermediate the side edges 50 and 51 thereof and generally parallel thereto. More particularly, the inlet channel 60 is disposed to be in register with the inlet channel 30 of the first internal plate 12.

The first array of channels 55 in the second internal plate 14 also is formed to define first and second tuning channels 62 and 64 which are disposed to be in register with the tuning channels 32 and 34 in the first internal plate 12. More particularly, the tuning channels 62 and 64 intersect the inlet channel 60 at approximately right angles. The first tuning channel 62 undergoes an approximately right angle bend such that locations thereon spaced from the inlet channel 60 are generally parallel to the inlet channel 60. The tuning channel 62 is substantially continuous along its entire length and does not include a tuning aperture comparable to the tuning aperture 36 in the inlet channel 32. The inlet channel 64 also undergoes an approximately right angle bend to be directed back toward the first end 52 of the second internal plate 14. The tuning channel 64 terminates at a tuning aperture 66.

The second array of channels 56 formed in the second internal plate 14 comprises a perforated channel 68, a smoothly curved reversing channel 70, a return channel 72 and an outlet channel 74, all of which are disposed to be in register with corresponding channels in the first internal plate 12. The perforated channel 68 is characterized by an array of perforations 76 formed therein. The return channel 72 terminates at a cross flow aperture 78, while the outlet channel 74 extends from a second cross flow aperture 79 to the second end 53 of the second internal plate 14.

The intermediate channel 58 extends between and connects the inlet channel 60 and the perforated channel 68. Again, it will be noted that a line L' or plane can be extended entirely across the second internal plate 14 between the sides 50 and 51 thereof to intersect only the intermediate channel 58.

The plates 12 and 14 are secured together such that the registered channels define first and second spaced apart arrays of tubes and a single intermediate tube extending between the arrays.

The external shell 16 is provided with a generally planar peripheral flange 80 extending entirely thereabout. However, the peripheral flange 80 is characterized by arcuate portions 82 and 84 which will engage the inlet and outlet channels 30 and 44 respectively of the first internal plate 12.

The first external shell 16 is further stamp formed to define a low frequency resonating chamber 86 and an expansion chamber 88 which extend from the plane of the peripheral flange 80. A crease 90 separates the low frequency resonating chamber 86 from the expansion chamber 88. More particularly, the crease 90 effectively connects opposed locations on the peripheral flange 80. The crease 90 is spaced from the end of the external shell 16 adjacent the outlet portion 82 by a distance "c" which is greater than the distance "a" identified above with respect to the internal plates 12 and 14, but less than the distance "b". As a result, the low frequency resonating chamber 86 will completely enclose the first array of channels 25 formed in the first internal plate 12, while the expansion chamber 88 will completely enclose the second array of channels 26 formed in the first internal plate 12.

The crease 90 in the external shell 16 is characterized by an outwardly convex arcuate portion 92 which is dimensioned and disposed to tightly engage the intermediate channel 28. Portions of the crease 90 on either side of the arcuate portion 92 lie substantially in the same plane as the peripheral flange 80. More particularly, the dimensions of the low frequency resonating chamber 86 and the expansion chamber 88 are selected to ensure that the crease 90 is disposed at a longitudinal location at which only the single intermediate channel 28 is disposed on the first internal plate 12. Thus, only one outwardly convex arcuate portion 92 is required in the transverse crease 90, and there are no recesses, pockets, reservoirs or other areas that could retain liquids or caustic chemicals that could contribute to decay of the external shell 16.

The second external shell 18 is depicted as being generally a mirror image of the first external shell 16. However, it is to be understood that the precise configurations of the first and second external shells 16 and 18 would be dictated largely by the available space on the vehicle. Furthermore, the specific volumes of the chambers stamp formed in the external shells 16 and 18 would be dictated by the acoustical characteristics of the sound to be attenuated. Normally, these acoustical characteristics would be such that the low frequency resonating chambers would be of different volumes, and therefore different configurations.

With reference to FIG. 1, the second external shell 18 comprises a generally planar peripheral flange 100 which is configured to be secured in generally face-to-face contact with the second internal plate 14. The generally planar peripheral flange 100 is characterized by arcuate portions 102 and 104 at the opposed ends thereof which are disposed and configured to engage peripheral portions of the inlet and outlet channels 60 and 74 of the second internal plate 14.

The second external shell 18 is further characterized by a low frequency resonating chamber 106 and an expansion chamber 108 which are separated from one another by a transversely extending crease 110. The crease 110 is characterized by an outwardly convex arcuate portion 112 disposed to engage the intermediate channel 58 of the second internal plate 14. The crease 110 is disposed at a distance "c" which is between dimensions "a" and "b" from the first end 52 of the second external shell 18 to extend across the internal plate 14 at a location thereon where only the single intermediate channel 58 is disposed. Thus, the crease 110 is substantially planar along its entire length except for the one outwardly convex arcuate portion 112 for engaging the intermediate channel 58. As depicted in the FIGS. hereto, the external shell 18 defines the bottom portion of the muffler 10. Thus, the accumulation of corrosive materials is not a problem. However, the existence of only a single arcuate portion simplifies and facilitates the formation of the metallic material in the vicinity of the crease 110.

Figure 4:
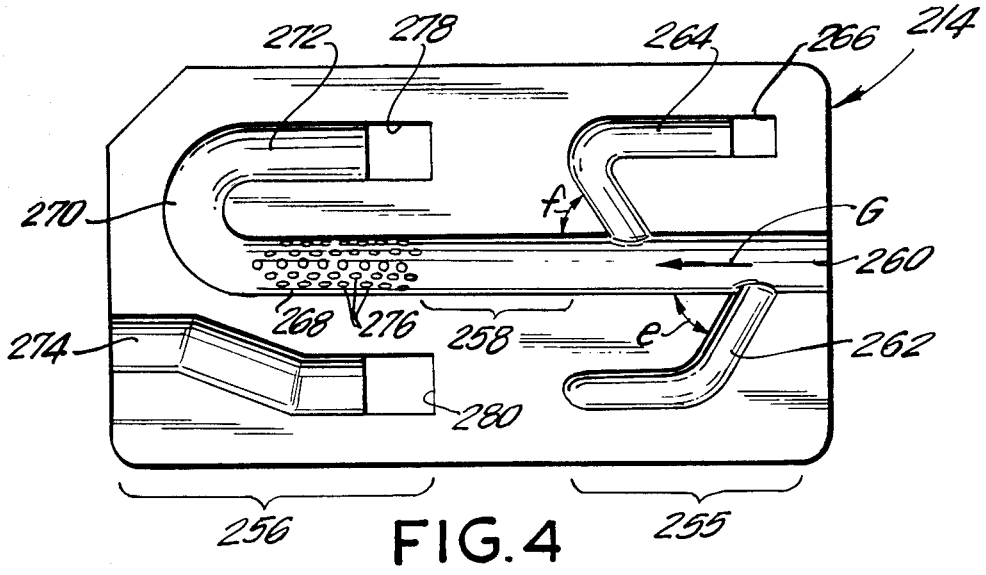
FIG. 4 is a cross-sectional view similar to FIG. 2 but showing an alternate orientation of the tuning tubes.

An alternate configuration for the internal plates of the muffler 10 is depicted in FIG. 4. More particularly, the internal plate 214 comprises a first array of channels 255 with an inlet channel 260 and tuning channels 262 and 264. The second array of channels 256 comprises a perforated channel 268, a curved reversing channel 270, a return channel 272 and an outlet channel 274. The return channel 272 terminates at a cross flow aperture 278. The outlet channel 274 extends from a cross flow aperture 280 to a peripheral end portion of the internal plate 214. An intermediate channel 258 extends between and connects the first and second arrays 255 and 256.

Tuning channels 262 and 264 extend from and intersect the inlet channel 260. The tuning channel 264 terminates at a tuning aperture 266. However, unlike the tuning channels of the internal plate 14 described above, the tuning channels 262 and 264 intersect the inlet channel 260 at acute angles. More particularly, the flow of exhaust gas is indicated by the arrow "G" in FIG. 4. The intersection of the tuning channels 262 and 264 is aligned with respect to downstream locations of the inlet channel 260 to define an acute angle, as indicated by angles "e" and "f" respectively. These acute angle orientations of the tuning channels 262 and 264 achieves or approximates a "driven" tuning which in some instances is more effective. The tuning channel 262 extends along its acute angle alignment to the inlet channel 260 and then undergoes a bend to extend generally parallel to the inlet channel 260. As noted above, this angular bend along the length of the tuning channel 262 enables the tuning channel 262 to achieve the important length required to attenuate low frequency sounds. Similarly, the tuning channel 264 undergoes a bend of greater than 90° to extend back toward the inlet end of internal plate 214 and generally parallel to the inlet channel 260. Again, this bend enables the tuning channel 264 to achieve the critical length required to attenuate low frequency sounds.

In summary, a stamp formed muffler is provided with a pair of internal plates and a pair of external shells. The internal plates are stamp formed to define spaced apart arrays of tubes therebetween, including an inlet to the muffler and an outlet from the muffler. A single intermediate tube connects the spaced apart arrays. The first array of tubes are characterized by perforations, louvers or apertures to permit an expansion of exhaust gases traveling through the tubes. The second array of tubes comprises at least one tuning tube intersecting at least one other tube in the array. The intermediate tube defined by the internal plates is disposed such that at at least one location on said internal plates, a straight line connecting two opposed peripheral locations on the internal plates will intersect only the one intermediate tube. The external shells are formed to define a plurality of chambers. Two chambers on at least one external shell are separated from one another by a crease connecting spaced apart peripheral locations on the external shell. The crease is disposed to extend across a location on the internal plates at which only the one intermediate tube is disposed. Thus, the crease is characterized by only a single outwardly convex portion for engaging the single tube defined in the internal plates. As a result, the crease is not provided with recesses that could trap corrosive materials.

While the invention has been described with respect to a preferred embodiment, it is understood that various changes can be made without departing from the scope of the invention as defined by the appended claims.

What is claimed is:

1. A stamp formed muffler comprising:

first and second plates secured in face-to-face relationship, said plates being stamp formed to define arrays of channels disposed in generally opposed relationship such that the channels of one plate and the channels of the other plate define first and second spaced apart arrays of tubes and a single intermediate tube extending between and connecting said first and second arrays, one said array of tubes comprising an inlet tube to the muffler, and the other of said arrays comprising an outlet tube from the muffler; and at least one external shell having a peripheral portion secured to said internal plates, said external shell being formed to define a plurality of chambers extending from said peripheral portion, said chambers being separated from one another by a crease connecting spaced apart peripheral portions on said external shell, said crease being characterized by only one outwardly convex portion disposed to engage said intermediate tube, portions of said crease being generally planar intermediate said convex portion and said peripheral portions of the shell.

2. A muffler as in claim 1 wherein at least one tube in said arrays is provided with perforation means extending therethrough for permitting expansion of exhaust gases therefrom.

3. A muffler as in claim 1 wherein the tubes in at least one of said arrays define a plurality of generally parallel tubes.

4. A muffler as in claim 1 wherein at least one said array comprises at least one tuning tube.

5. A muffler as in claim 4 wherein said tuning tube is nonlinear.

6. A muffler as in claim 5 wherein said tuning tube communicates with another tube in the array and wherein a portion of said tuning tube is disposed in nonperpendicular alignment to the tube of said array with which said tuning tube communicates.

7. A muffler as in claim 4 wherein said tuning tube is nonlinear, said tuning tube intersecting and communicating with the inlet tube of said muffler.

8. A muffler as in claim 7 wherein said nonlinear tuning tube intersects said inlet tube at a right angle.

9. A muffler as in claim 7 wherein said nonlinear tuning tube intersects said inlet tube at an acute angle, such that said tuning tube is aligned at an acute angle to downstream portions of said inlet tube.

10. A muffler as in claim 7 comprising two external shells and two of said tuning tubes.

11. A muffler as in claim 1 wherein the peripheral portion of said external shell defines a flange which is generally planar for a substantial portion of the periphery of the external shell, the planar portions of said crease being disposed generally in the plane of the peripheral flange.

12. A stamp formed exhaust muffler comprising:

first and second internal plates secured in face-to-face relationship, said internal plates being stamp formed to define arrays of channels, said channels being disposed in generally opposed relationship such that the channels of one said internal plate and the channels of the opposed internal plate define first and second spaced apart arrays of tubes and a single intermediate tube extending between and connecting said first and second arrays, said first array of tubes comprising an inlet to the muffler, said second array of tubes comprising an outlet from the muffler; and a pair of external shells having peripheral portions secured respectively to said internal plates, said shells being formed to define chambers surrounding at least portions of said internal plates, at least one of said external shells being stamp formed to define first and second chambers separated from one another by a crease extending therebetween, said crease being disposed to align with and extend across a portion of said internal plates on which the intermediate tube is disposed, said crease being characterized by one outwardly extending convex portion disposed and dimensioned to engage the intermediate tube, portions of said crease intermediate said convex portion and the peripheral portions of said tube being generally planar.

13. A muffler as in claim 12 wherein each said array comprises a plurality of tubes defined by the channels of said internal plates.

14. A muffler as in claim 13 wherein one of said arrays comprises a plurality of nonlinear tuning tubes.

15. A muffler as in claim 13 wherein at least one tube in one of said arrays comprises aperture means for permitting expansion of exhaust gases traveling therethrough.

16. A muffler as in claim 12 wherein said external shells comprise peripheral flanges which are generally planar, the planar portions of said crease lying generally in the same plane as said peripheral flange of said external shell.

17. A muffler as in claim 12 wherein said first array of tubes comprises first and second nonlinear tuning tubes communicating with the inlet to the muffler.

* * * * *